US008595938B2

(12) United States Patent
Bodet

(10) Patent No.: US 8,595,938 B2
(45) Date of Patent: Dec. 3, 2013

(54) MANUAL RAZOR WITH PIVOTING SHAVING HEAD

(75) Inventor: Herve Bodet, Verdun (FR)

(73) Assignee: Lindal France SAS, Briey (FR)

( * ) Notice: Subject to any disclaimer, the term of this patent is extended or adjusted under 35 U.S.C. 154(b) by 534 days.

(21) Appl. No.: 12/742,303

(22) PCT Filed: Oct. 21, 2008

(86) PCT No.: PCT/EP2008/064174
§ 371 (c)(1),
(2), (4) Date: May 11, 2010

(87) PCT Pub. No.: WO2009/068369
PCT Pub. Date: Jun. 4, 2009

(65) Prior Publication Data

US 2011/0277326 A1 Nov. 17, 2011

(30) Foreign Application Priority Data

Nov. 28, 2007 (FR) ..... 07 59367

(51) Int. Cl.
*B26B 19/40* (2006.01)

(52) U.S. Cl.
USPC ..... 30/41; 30/527; 30/47

(58) Field of Classification Search
USPC ..... 30/41, 64, 57, 151–154, 526, 528, 58, 30/34.05, 34.1, 32, 531, 533, 535; 7/168; 74/89.11, 109
See application file for complete search history.

(56) References Cited

U.S. PATENT DOCUMENTS

| | | | | | |
|---|---|---|---|---|---|
| 891,259 | A * | 6/1908 | Fuller | 65/292 |
| 1,145,984 | A * | 7/1915 | Fuller | 30/57 |
| 2,565,281 | A * | 8/1951 | Thomas | 30/37 |
| 2,820,288 | A * | 1/1958 | Malecki | 30/67 |
| 4,077,119 | A | 3/1978 | Sellera | |
| 4,083,103 | A | 4/1978 | Estandian | |
| 4,841,635 | A * | 6/1989 | Maurizi et al. | 30/41 |
| 4,977,669 | A | 12/1990 | Clifford | |
| 5,070,614 | A * | 12/1991 | Hardin et al. | 30/527 |
| 5,269,062 | A * | 12/1993 | Dallaire et al. | 30/41 |
| 5,465,488 | A | 11/1995 | Yaw et al. | |
| 5,701,674 | A * | 12/1997 | Mitchell | 30/41 |
| 5,761,813 | A * | 6/1998 | Frick et al. | 30/41 |
| 7,051,439 | B2 * | 5/2006 | Tomassetti | 30/41 |
| 7,503,118 | B2 * | 3/2009 | Oh | 30/43.1 |
| 2010/0107415 | A1 * | 5/2010 | Kurzet | 30/41 |

OTHER PUBLICATIONS

International Search Report of PCT/EP2008/064174, date of mailing Feb. 4, 2009.

* cited by examiner

*Primary Examiner* — Stephen Choi
*Assistant Examiner* — Fernando Ayala
(74) *Attorney, Agent, or Firm* — Westerman, Hattori, Daniels & Adrian LLP

(57) ABSTRACT

The invention relates to a manual razor including a shaving head (10) having a attached on a handle (20), pivoting means (11, 21) between the head (10) and the handle (20) so that the head (10) can move from a use position perpendicular to the handle (20) into a stowage position parallel to the handle. In order for the razor to be easily stored while occupying as little space as possible, the blade can be pivoted without touching the blade, using a rack (21) provided on a sliding button located on the handle (20), and a toothed wheel (11) connected to the head (10), wherein the toothed wheel (11) and the rack (21) are sized and arranged to be in mutual engagement.

4 Claims, 5 Drawing Sheets

1
10
13
14
20
22
24
28
29
A
B

MANUAL RAZOR WITH PIVOTING SHAVING HEAD

BACKGROUND OF THE INVENTION

The invention relates to a manual razor comprising a shaving head equipped with a blade and a handle on which the shaving head is fixed, with pivoting means being provided between the head and the handle so as to allow the head to move from an in-use position perpendicular to the handle to a storage position parallel to the handle, wherein the pivoting means are made of a rack placed on a sliding button located on the handle and a toothed wheel integral with the head, the toothed wheel and the rack being proportioned and placed so as to intermesh.

These conventional razors have a disadvantage in that the shaving head is in a position perpendicular to the handle. This makes them fairly sizable, especially for travel. In addition to the problem of the space taken by the razor, there is also the need to take along a shaving gel or cream, which is generally in the form of a pressurized bottle.

From documents U.S. Pat. No. 4,977,669 A, U.S. Pat. No. 5,269,062 A and U.S. Pat. No. 4,841,635, travel razors are known whose head can pivot from an in-use position to a storage position parallel to the handle. The device as a whole is proportioned so that in the storage position, the blade can be enclosed inside a cap that bears on the razor handle. The blade must be pivoted manually, which is not without risk.

From document U.S. Pat. No. 5,465,488 A, a travel razor with a pivoting blade is known. Pivoting means are provided so that the blade can be put away without having to touch it. These means are made up of a shaft, firstly, with the blade support attached to the end thereof using a pivot pin. A rod, parallel to the shaft, is equipped with a projection that goes into a slot on the blade support near the pivot pin. The shaft and the rod can be moved simultaneously to make the blade come out of the razor handle. When the blade support has come out, the shaft continues to move while the rod is kept still. This results in a relative movement of the projection and the pivot pin, which causes the blade support to pivot. In order to make the shaft and the rod move simultaneously, and then make the shaft move alone, the document proposes a dual set of guides, one rectilinear and the other spiral, placed on two different concentric parts. Projections on the shaft and the rod engage with this dual set of guides. This system entails a great number of parts.

Document U.S. Pat. No. 4,083,103 A proposes a razor whose blade, which is placed on a support that is tilted relative to the handle, can be pivoted to put it in an angular position optimal for shaving. For this purpose, the invention provides a bevel gear system enabling the transmission of a rotational movement given by turning a knob located at the bottom of the handle on the axis on which the blade support is placed. For this purpose, the knob is fixed to the first end of a shaft whose second end is equipped with the first element of a bevel gear. The blade support is mounted in turn on the first end of a second shaft whose other end carries the second bevel gear element. In order to lock the blade into the desired position, a screw ring is provided. This device, which entails a great number of parts, enables the blade to be tilted 45° from the horizontal.

Given their complexity, the razors in documents U.S. Pat. No. 5,465,488 A and U.S. Pat. No. 4,083,103 A are not suitable for disposable razors.

SUMMARY OF THE INVENTION

The objective of the present invention is to provide a razor that can easily be stored while occupying as little space as possible. For this purpose, it must be equipped with pivoting means for the blade support, so that one does not have to touch the blade in order to make it pivot. These pivoting means must be simple and inexpensive to manufacture, as well as reliable. Another objective of the invention is to combine a razor and an aerosol containing a shaving gel or cream.

This objective is achieved according to the invention in that the pivoting means can be made of a rack placed on a sliding button located on the handle and a toothed wheel integral with the head, the toothed wheel and the rack being proportioned and placed so as to intermesh. This system can be made easily and inexpensively, and does not require many assembly steps.

In order to reduce the overall size, the pivoting means and/or the part of the handle on which the pivoting means are located will preferably be proportioned so that in the storage position, the projection of the head along the main axis of the handle is located within the surface defined by the section of the widest part of the handle. This way, it is possible to equip the razor with a cap that can cover the head and the part of the handle that holds the head when the latter is in the storage position.

In a preferred variant of the invention, the handle of the razor is equipped with a recess in which a pressurized bottle can be received, with a dispenser that can be placed on the valve of a pressurized bottle, and with a push button to operate the valve of a pressurized bottle placed in the handle. In this way, the razor and the shaving gel or cream are combined into a single object. This reduces the overall size accordingly.

To prevent dirt from getting on the outlet orifice for the gel or cream during storage, it is preferable to have at least part of the pivoting means, preferably the sliding button, covering the dispenser orifice when the head is in the storage position. Means can also be provided for locking the dispenser and/or the valve of the pressurized bottle in order to prevent activating the aerosol unintentionally.

The recess intended for holding a pressurized bottle is preferably equipped with a cover that can close off the recess. In this way, the pressurized bottle is kept from coming out of its recess. Instead of or in addition to the cover, snap-in means can also be provided for snapping the bottle into the recess.

BRIEF DESCRIPTION OF THE DRAWINGS

The invention is described below in detail, using an example of an embodiment, shown in the following figures:

FIG. 5: a side view of a razor in the stored position with its cap on;

Figures 1A, 1B, 2A, 2B:
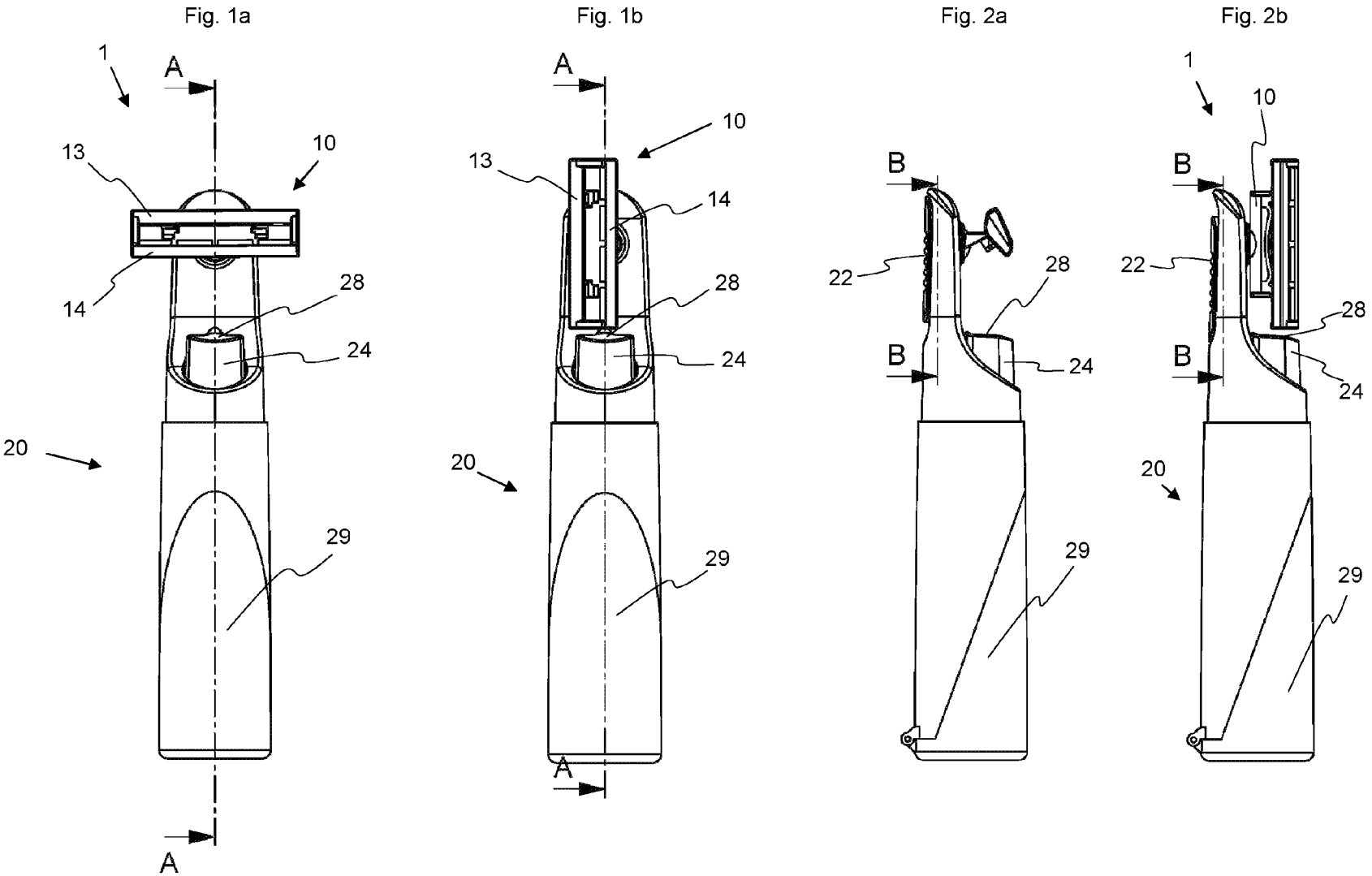
FIG. 1: a front view of the razor according to the invention (a) in the in-use position and (b) in the storage position.
FIG. 2: a side view of the razor according to the invention (a) in the in-use position and (b) in the storage position.
Figure 3C:
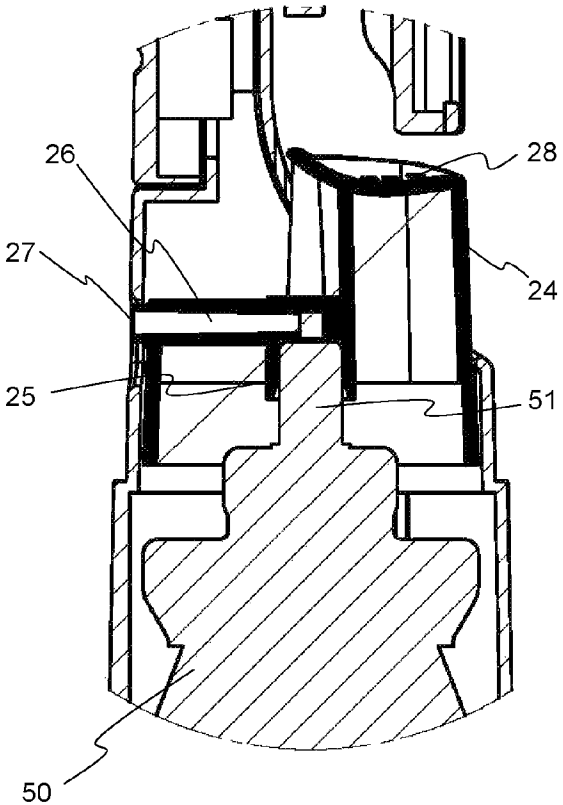
FIG. 3: a sectional side view along the line A-A in FIG. 1 of the razor according to the invention (a) in the in-use position, (b) in the storage position, and (c) an enlargement of the part containing the dispenser.
Figure 3B:
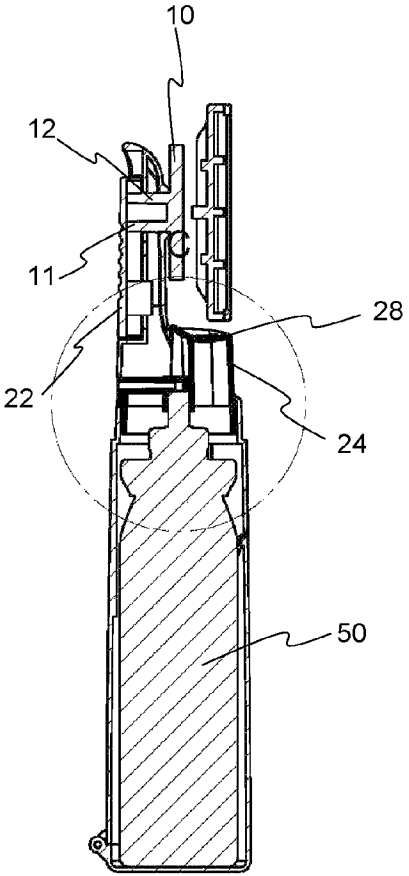
Figure 3A:
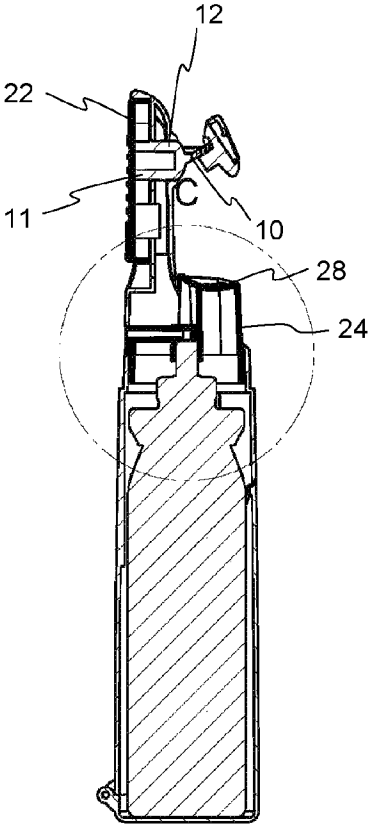
Figure 4B:
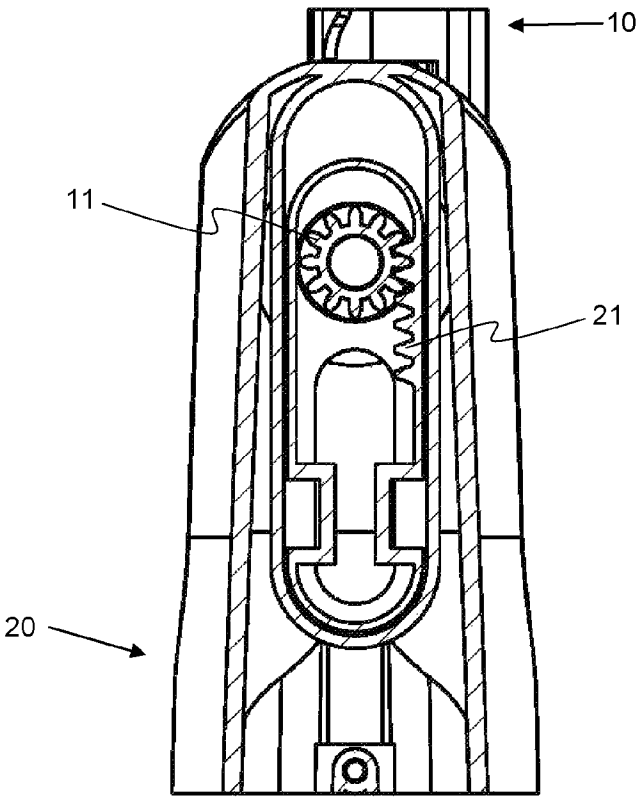
FIG. 4: a sectional view along the line B-B in FIG. 2 of a razor according to the invention (a) in the in-use position and (b) in the storage position.
Figure 4A:
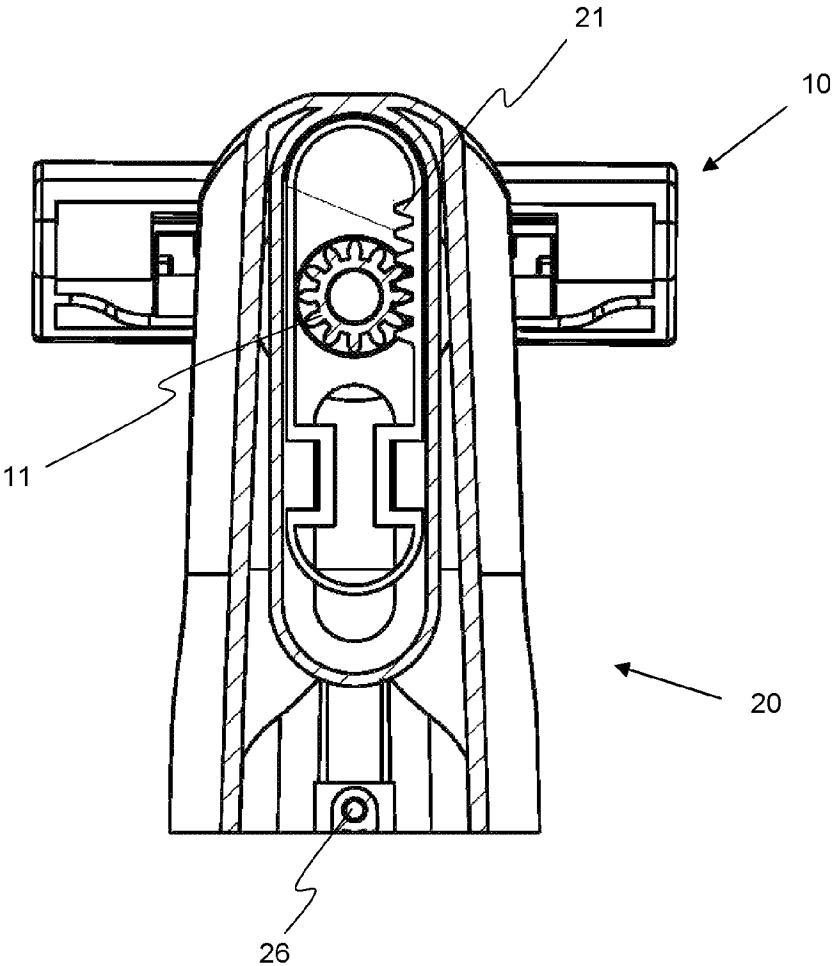
Figure 6:
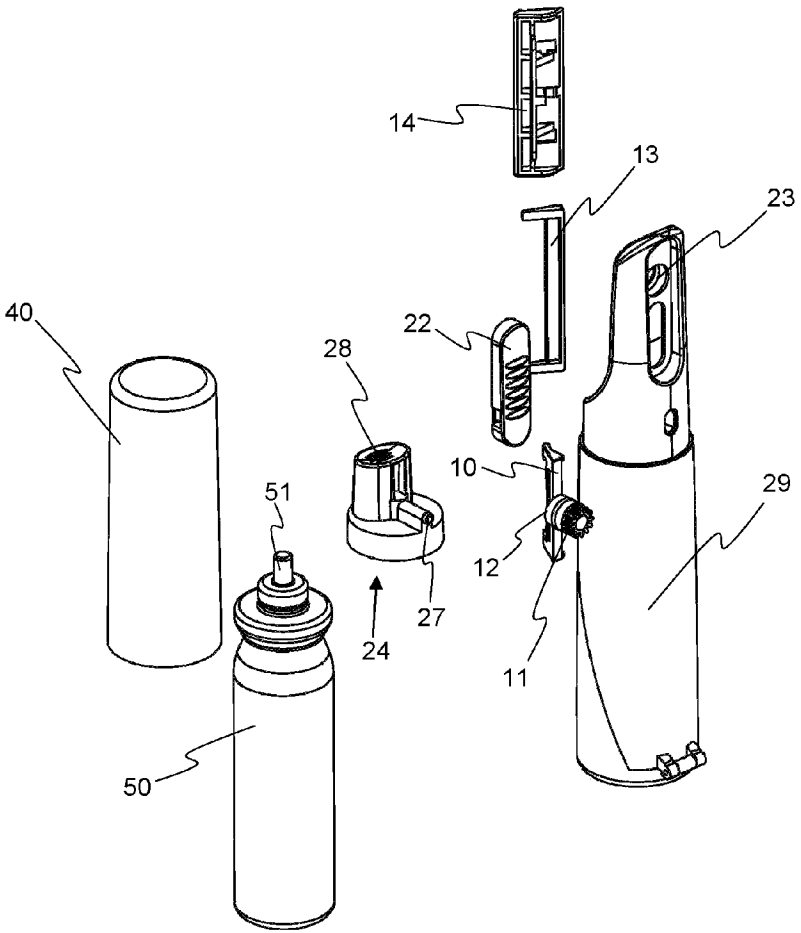
FIG. 6: an exploded view of the various parts of the razor according to the invention.
Figure 5:
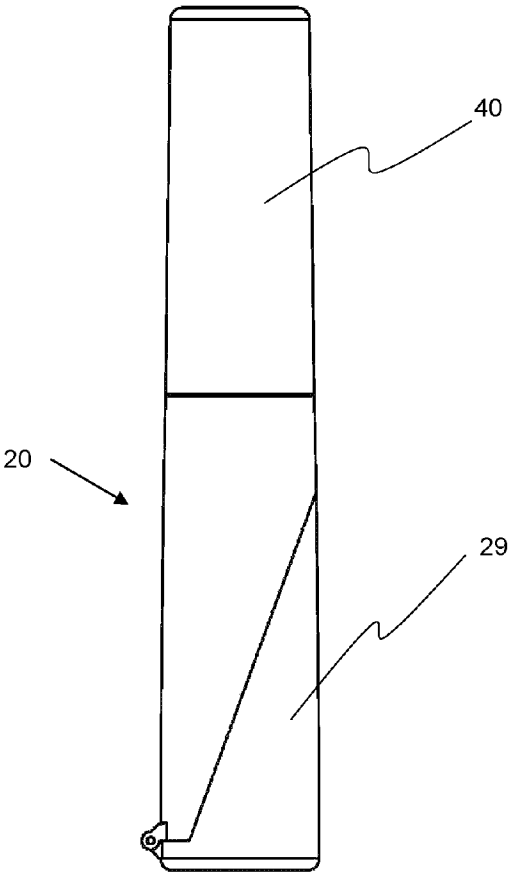

7*a*-7*c*, with sliding button uncovering the dispenser orifice in an operating position of the blade.

DETAILED DESCRIPTION OF PARTICULAR EMBODIMENTS

The razor (1) of the invention is essentially made up of a head (10) carrying a blade, and a handle (20) on which the head (10) is pivotably placed.

Pivoting means are interposed between the head (10) and the handle (20). These pivoting means serve to move the head from an in-use position, in which the head (10) is perpendicular to the handle (20), to a storage position, in which the head (10) is parallel to the handle (20).

These pivoting means are made up, for example, of a rack (21) integral with a sliding button (22) able to slide along the handle (20), and a toothed wheel (11) placed at the end of a pivot pin (12) placed in the center of the head (10). The pivot pin is pivotably housed in an opening (23) of the same size in the top part of the handle (20). Snap-in means are provided to hold this pivot pin in place. These snap-in means are made up of a groove in the opening (23) and a corresponding ridge provided on the pivot pin (12), or the reverse, for example. The rack (21) and the toothed wheel (11) are proportioned so they can intermesh.

In order to be able to protect the blade with a cap (40) when the razor is stored, the part of the handle (20) underneath the head (10) when the latter is in the storage position is preferably wider than the projection of the head with the blade, the pivoting means, and the part of the handle that holds the head. This way, it is possible to put the top part of the razor equipped with the head into the storage position inside the cap, and to make the latter press or snap onto the part of the handle located underneath the head in the storage position.

The shaving head is essentially made up of a base (10) with the pivot pin (12) holding the toothed wheel (11) attached to the middle thereof, and two elements (13, 14) that serve to support the blade.

In a preferred embodiment of the invention, the handle (20) is equipped with a recess into which a pressurized bottle (50) can be inserted. For this purpose, the handle is equipped with a dispenser (24) equipped with an end fitting (25) designed to be placed on the outlet valve (51) of the pressurized bottle (50), which end fitting is extended by an outlet passage (26) ending in an outlet orifice (27). In order to operate the valve (51) of the bottle (50), the dispenser (24) is designed to form a push button (28) on its top part.

In this embodiment, it is possible to insert a pressurized bottle (50) containing a shaving gel, for example, inside the handle (20). Pushing on the push button (28) makes gel come out of the outlet orifice (27). To avoid operating the push button (28) unintentionally, the latter is preferably hidden at least partially by the shaving head (10) when said head is in the storage position.

Figure 7A:
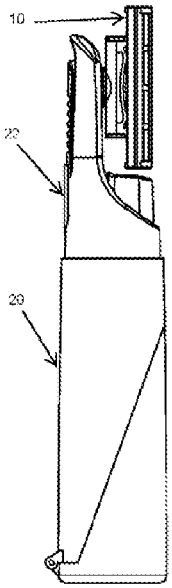
FIGS. 7*a*-7*c*: side view, rear view, and enlarged view of detail C of FIG. 7*b*, respectively, of a variant embodiment with sliding button covering the dispenser orifice in a storage position of the blade.
Figure 7B:
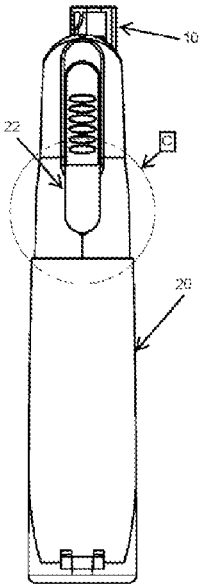
Figure 7C:
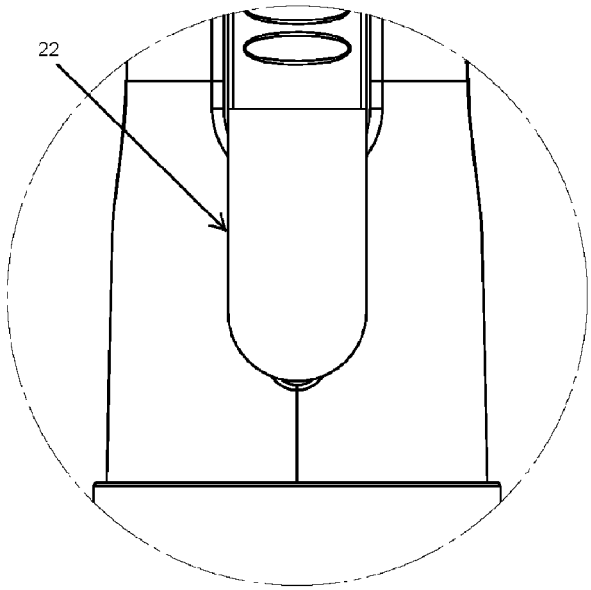
Figure 8A:
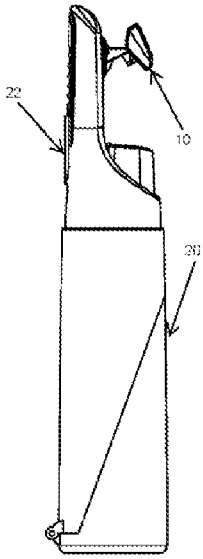
FIGS. 8*a*-8*c*: side view, rear view, and enlarged view of detail D of FIG. 8*b*, respectively, of the embodiment of FIGS.
Figure 8B:
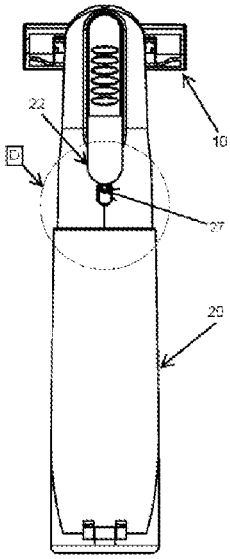
Figure 8C:
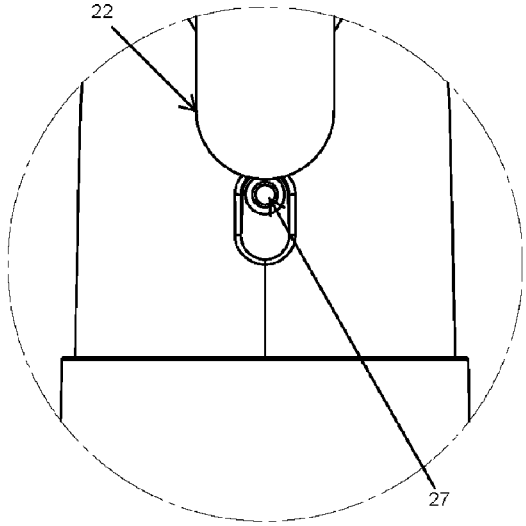

Likewise, the sliding button (22) preferably hides the orifice (27) when the blade is in the storage position. In the example given here, the storage position for the shaving head (10) corresponds to the low position of the sliding button (22). Such variant embodiment is illustrated on FIGS. 7*a*-7*c* which show sliding button (22) covering the dispenser orifice opening (27) in a storage position, and FIGS. 8*a*-8*c* which show sliding button 22 uncovering the diffuser opening 27 in a use position. It is also possible to provide means for locking the push button (28) when the shaving head (10) is in the storage position.

It is preferable to enclose the pressurized container inside the handle (20) by providing the latter with a cover (29). One can then be sure that the bottle will stay in place in the recess intended for this purpose. Additionally or alternatively, it would also be possible to provide snap-in means for snapping the pressurized bottle into the recess provided in the handle.

LIST OF REFERENCES

1 Razor
10 Shaving head
11 Toothed wheel
12 Pivot pin
13 Support for the blade
14 Support for the blade
20 Handle
21 Rack
22 Sliding button
23 Opening for housing the pivot pin
24 Dispenser
25 Valve end fitting
26 Passage
27 Dispenser outlet
28 Push button
29 Cover
40 Cap
50 Pressurized bottle
51 Outlet valve

The invention claimed is:

1. Manual razor comprising:

a shaving head equipped with a blade, and a handle on which the shaving head is fixed, pivoting means being provided between the head and the handle so as to allow the head to move from an in-use position perpendicular to the handle to a storage position parallel to the handle, wherein the pivoting means are made of a rack placed on a sliding button located on the handle and a toothed wheel integral with the head, the toothed wheel and the rack being proportioned and placed so as to intermesh;

wherein the razor handle is equipped with a recess in which a pressurized bottle can be received, a dispenser that can be placed on a valve of the pressurized bottle, wherein the dispenser has an orifice for dispensing a product contained in the pressurized bottle, and a push button to operate the valve of the pressurized bottle, wherein the sliding button covers the dispenser orifice when the head is in the storage position.

2. Manual razor according to claim 1, wherein the pivoting means and/or the part of the handle on which the pivoting means are located are proportioned so that in the storage position, the handle at its widest part is wider than the projection of the head along the main axis of the handle on the plane defined by the transverse cross-section of the handle at its widest part.

3. Manual razor according to claim 1, which is equipped with a cap that can cover the head and the part of the handle that holds the head when the latter is in the storage position.

4. Manual razor according to claim 2, which is equipped with a cap that can cover the head and the part of the handle that holds the head when the latter is in the storage position.

* * * * *